US009873494B2

(12) United States Patent
Jewell

(10) Patent No.: US 9,873,494 B2
(45) Date of Patent: Jan. 23, 2018

(54) AUTONOMOUS UNDERWATER VEHICLE HOVER APPARATUS, METHOD, AND APPLICATIONS

(71) Applicant: FAIRFIELD INDUSTRIES INCORPORATED, Sugar Land, TX (US)

(72) Inventor: Stephen W. Jewell, Alvin, TX (US)

(73) Assignee: Fairfield Industries Incorporated, Sugar Land, TX (US)

( * ) Notice: Subject to any disclaimer, the term of this patent is extended or adjusted under 35 U.S.C. 154(b) by 102 days.

(21) Appl. No.: 14/774,766

(22) PCT Filed: Mar. 7, 2014

(86) PCT No.: PCT/US2014/021978
§ 371 (c)(1),
(2) Date: Sep. 11, 2015

(87) PCT Pub. No.: WO2014/193510
PCT Pub. Date: Dec. 4, 2014

(65) Prior Publication Data

US 2016/0016649 A1 Jan. 21, 2016

Related U.S. Application Data

(60) Provisional application No. 61/777,273, filed on Mar. 12, 2013.

(51) Int. Cl.
*B63B 21/24* (2006.01)
*B63B 21/26* (2006.01)
(Continued)

(52) U.S. Cl.
CPC ..... *B63G 8/001* (2013.01); *B63B 21/227* (2013.01); *B63B 22/18* (2013.01); *B63G 8/08* (2013.01);
(Continued)

(58) Field of Classification Search
CPC . B63B 21/227; B63B 22/18; B63B 2022/006; B63B 2205/00; B63B 2205/02; B63B 2205/04; B63B 2205/06; B63B 2205/08; B63B 2211/02; B63B 2702/08; B63G 8/001; B63G 8/08; B63G 8/14;
(Continued)

(56) References Cited

U.S. PATENT DOCUMENTS 2,468,077 A 4/1949 Kellum
3,646,771 A * 3/1972 Greene ..... B63B 21/50 244/110 F
(Continued)

FOREIGN PATENT DOCUMENTS

DE 102006020694 A1 * 11/2007 ..... B63B 21/24

OTHER PUBLICATIONS

International Search Report and Written Opinion for International Application No. PCT/US2014/021978, International Filing Date Mar. 7, 2014, 11 pages.

*Primary Examiner* — Ajay Vasudeva
(74) *Attorney, Agent, or Firm* — Bond, Schoeneck & King, PLLC; William Greener

(57) ABSTRACT

An autonomous underwater vehicle (AUV) including a deployable anchor and a method for operating an AUV having a deployable anchor in a hover mode.

16 Claims, 15 Drawing Sheets

(51) Int. Cl.

| | |
|---|---|
| ***B63B 21/50*** | (2006.01) |
| ***B63G 8/00*** | (2006.01) |
| ***B63G 8/08*** | (2006.01) |
| ***B63G 8/14*** | (2006.01) |
| ***B63G 8/20*** | (2006.01) |
| ***B63B 21/22*** | (2006.01) |
| ***B63B 22/18*** | (2006.01) |
| *B63B 22/00* | (2006.01) |

(52) U.S. Cl.
CPC ..... *B63G 8/14* (2013.01); *B63G 8/20* (2013.01); *B63B 2022/006* (2013.01); *B63B 2205/02* (2013.01); *B63B 2211/02* (2013.01); *B63G 2008/004* (2013.01)

(58) Field of Classification Search
CPC ... B63G 8/16; B63G 8/18; B63G 8/20; B63G 2008/002; B63G 2008/004; B63G 2008/005
See application file for complete search history.

(56) References Cited

U.S. PATENT DOCUMENTS

| | | | | |
|---|---|---|---|---|
| 5,666,900 | A | 9/1997 | Carroll, III et al. | |
| 2005/0279270 | A1 | 12/2005 | Wingett et al. | |
| 2013/0239869 | A1* | 9/2013 | Hesse ..... | B63G 7/02 114/330 |

* cited by examiner

AUTONOMOUS UNDERWATER VEHICLE HOVER APPARATUS, METHOD, AND APPLICATIONS

RELATED APPLICATION DATA

The instant application claims priority to U.S. provisional application Ser. No. 61/777,273 filed Mar. 12, 2013, the subject matter of which is incorporated herein by reference in its entirety.

BACKGROUND

Aspects and embodiments of the invention are directed to Autonomous Underwater Vehicles (AUVs) and methods for controlling an AUV; more particularly, AUVs equipped and enabled to operate in a hover mode and methods for controlling the operational hover mode as well as its engagement and disengagement.

Autonomous Underwater Vehicles (AUVs) are well developed and used in numerous subsea applications, most notably collecting bathymetric data and ocean bottom imaging by means of sensors carried aboard. As the name implies, these vehicles operate autonomously without pilots, unlike Remotely Operated Vehicles (ROVs), which typically include a coupled tether management system (TMS) as known in the art. Although AUVs may have an acoustic communication mechanism for communication with a separated, distant launch/retrieval platform, for the most part a flight plan is loaded into an onboard computer, the vehicle (AUV) is lowered into the water, and it flies that flight plan usually following the marine bottom closely to collecting data of interest.

AUVs generally carry their own onboard power source such as batteries or fuel cells, further differentiating them from ROVs. The onboard power source must power both the vehicle's propulsion as well as the onboard instrumentation. To minimize the power used for propulsion and maximize battery life and mission duration almost all AUVs take the shape of a torpedo, as illustrated in FIG. 1. This torpedo shape minimizes the vehicle's drag in the water.

Depending on the mission and depth rating of the AUV, its length, girth, and weight can range quite broadly. Shallow rated vehicles, e.g., may be as small as 6 feet in length, 10 inches in diameter, and weigh only a few hundred pounds (e.g., Bluefin Robotics). AUVs depth rated to 10,000 feet or more may commonly be as long as 21 feet, 40 inches in diameter, and weigh between 2000 and 3300 pounds in the air (e.g., Kongsberg; C&C Technologies). As known, all AUVs are made near neutrally buoyant in the water by use of syntactic foam or other recognized means.

The aforementioned torpedo design conserves power, allowing for longer missions given a fixed amount of power. AUVs of this design are typically capable of two-day long missions, although advances in battery and fuel cell technology promise longer duration missions in the future. Of these torpedo-like AUVs, there are some generally shared features amongst all of them. For example, propulsion derives from a variable speed propeller driven by an electric motor near or at the rear of the vehicle (FIG. 1). Flight surfaces, e.g., an elevator and rudder are generally mounted just forward of the propeller and may be replicated in whole or in part farther forward on the vehicle, depending on the mission. In some cases, flight surfaces may be absent and the main propeller or propulsion system is articulated so as to direct thrust as needed for steering. While there do exist AUVs with thrusters, these are generally smaller, lighter vehicles for shallow water applications such as, e.g., hull inspection. Typical torpedo-like AUVs do not have thrusters but rather depend on hydrostatic forces of water moving over their adjustable flight surfaces (wings) to adjust their heading and/or depth (FIG. 15).

AUVs of this aforementioned style are very mature and capable, and are used in all of the oceans of the world for survey work. Their dependence, however, on the hydrostatic forces of water acting on their flight surfaces or the body of the vessel for control, which is largely derived from their forward motion through the water, ill adapts them for hovering still and controlled hovering in the water column. While horizontal and vertical thrusters could be added to the vehicle to add this capability, this substantially adds to the vehicle's complexity and cost as well as adding drag that affects speed and/or mission duration given fixed battery life. Those skilled in the art will appreciate that there are other reasons beyond cost and complexity why even tunnel thrusters are problematical for the applications embodied by the instant invention.

A technique of ocean bottom seismic sensing involves downloading data from a series of Ocean Bottom Seismic nodes (OBS nodes or, simply 'nodes'). Like the AUV, nodes are autonomous; they contain a self-contained power source and are able to record and store large amounts of seismic, electromagnetic, and similar data recorded by various sensors contained in the node. Data may be communicated with the node via multiple mechanisms; for example, wireless acoustic methods are commercially available, however bandwidth for such systems is very low, even over short distances. A node may have 64 gigabytes or more of recorded data to be recovered by the AUV. Thus, radio frequency (RF) or optical communications remain available as choices. Radio frequencies require very close antenna proximity as sea water is very poor at transmission of radio frequencies, with attenuation in excess of 40 db/meter. Optical transmission can carry very high bandwidths depending on the technology employed but transmission fidelity is adversely affected by the turbidity of the water, which would be made more problematic by AUV thrusters. Operating near a muddy ocean bottom as is found in the Gulf of Mexico, for example, thrusters tend to turn up the mud making optical transmission of data difficult or impossible. Turbidity in the deep ocean is generally not a problem except for the issues created by the vehicle itself. Whether via RF or optical transmission, and even assuming a gigabit/second or better transmission rate, large datasets are difficult to collect by a moving AUV; e.g., in motion a slow fly-by or tight circling pattern.

Although ROVs can hover and could perform the tasks at hand, ROVs require pilots, and while some ROVs can achieve speeds of torpedo-style AUVs, the speed with which ROVs can traverse a large field of widely spaced nodes (which may typically be deployed on a grid of 200-500 meters) is limited not by the ROV's speed but by the speed that the ROV's tether management system (TMS) can be towed through the water.

For these and other reasons known in the art, there exists a need to provide a conventional torpedo-styled, high-speed AUV with the ability to stop and controllably hover with stability over a target on the marine bottom. Advantageously, the ability to stop and hover the AUV would occur without forward speed and without thruster assistance, using the AUV's conventional flight surfaces for attitude, heading, and elevation control.

Definitions as Used Herein

AUV is an autonomous underwater vehicle.

The term 'vehicle' is used interchangeably with AUV generally with reference to motion or flight through the water.

A 'flight surface' refers to one or more wings or one or more elevators and rudders, which generally occur in pairs near the rear of the AUV in close proximity to the propeller. They may be aft of the propeller or closely spaced just forward of the propeller, and may be replicated at other points further forward on the vehicle.

'Effective operation of the flight surface' means that the flight surface is able to perform the intended function of the flight surface; e.g., positional and directional stability and control of the AUV when there is fluid flow across the flight surface.

The term 'propeller' or 'propeller mechanism' is disclosed as the apparatus to move the AUV through the water; however, any other controllable thrust system as known in the art would be suitable. Thus use of the term 'propeller' is not to be interpreted to exclude other thrust systems or techniques and may be used interchangeably herein.

The term 'about' means the amount of the specified quantity plus/minus a fractional amount (e.g., ±10%, ±9%, ±8%, ±7%, ±6%, ±5%, ±4%, ±3%, ±2%, ±1%, etc.) thereof that a person skilled in the art would recognize as typical and reasonable for that particular quantity or measurement. Likewise, the term 'substantially' means as close to or similar to the specified term being modified as a person skilled in the art would recognize as typical and reasonable; for e.g., within typical manufacturing and/or assembly tolerances, as opposed to being intentionally different by design and implementation.

SUMMARY

The most general aspects of the invention are an autonomous underwater vehicle (AUV) including a deployable anchor and a method for operating an AUV having a deployable anchor in a hover mode.

An aspect of the invention is an autonomous underwater vehicle (AUV) that includes an elongate body including a bow region and a stern region, wherein the body includes a cavity disposed between the bow region and the stern region; an anchor rode extender/retractor mechanism disposed within or on the body; an anchor rode coupled at one region thereof to the anchor rode extender/retractor mechanism; an anchor coupled to another region of the anchor rode and adapted to be disposed in the cavity in a retracted mode; and a propulsion/stabilization component. According to various exemplary, non-limiting embodiments, the AUV may include the following additional features, limitations, and/or characteristics:

- wherein the anchor further includes a shank portion connected at a free end thereof to the another region of the anchor rode;
  - wherein the shank portion is freely, pivotally connected to the anchor and moveable through a range of about zero degrees to about 90 degrees;
- further comprising an orifice disposed in the cavity, wherein the orifice provides a conduit for a high-pressure fluid exit from the AUV cavity;
- further comprising at least one of a fluid compressor and a fluid pump adapted to provide the high-pressure fluid exit from the AUV cavity through the orifice;
- wherein the propulsion/stabilization component includes a propeller mechanism disposed at or near the stern region and a controllable flight surface on the body;
- wherein the controllable flight surface comprises a pair of elevators and rudders disposed aft of the propeller or substantially forwardly immediately adjacent of the propeller;
- wherein the propulsion/stabilization component includes an articulated propeller mechanism;
- wherein the cavity is configured with respect to the anchor such that an exterior surface of the anchor is substantially flush with the body when the anchor is fully disposed in the cavity.

An aspect of the invention is a method for controlling a submersed AUV, including the steps of providing an AUV having a deployable anchor on an anchor rode in a cavity of the AUV, and at least one of a) a combined propulsion/stabilization component and b) a propulsion component and a controllable flight surface, traveling at a given speed in a substantially horizontal, X-direction, in a marine environment; reducing the speed of the AUV while maintaining a minimal thrust sufficient for effective operation of the flight surface; deploying the AUV anchor from the cavity so that it engages the bottom of the marine environment a predetermined distance short of a known target position on the bottom of the marine environment; paying out or taking up a length of the anchor rode so as to adjust a position of the AUV in the X-direction in relation to the known target position; and further reducing the speed of the AUV in the X-direction to zero while maintaining a thrust sufficient for effective operation of the flight surface, whereby the AUV is in a hover mode proximate the target position. According to various exemplary, non-limiting embodiments, the method may include the following additional steps, features, limitations, and/or characteristics:

- further comprising activating the at least one of the combined propulsion/stabilization component and the controllable flight surface so as to adjust a polar (radial), Y-position of the hovering AUV in relation to the target position;
  - wherein the flight surface is a rudder;
  - wherein the combined propulsion/stabilization component includes an articulated thrust mechanism;
- further comprising activating the at least one of the combined propulsion/stabilization component and the controllable flight surface so as to adjust a vertical (elevation), Z-position of the hovering AUV in relation to the target position;
  - wherein the flight surface is an elevator
  - wherein the combined propulsion/stabilization component includes an articulated thrust mechanism;
- further comprising exiting the hover mode by reeling-in the anchor rode, wherein the AUV is pulled backwards away from the target position and towards the anchor that is engaged with the bottom of the marine environment;
  - further comprising jetting a fluid at a determined high pressure from an orifice in the cavity when the anchor is in close proximity to the cavity and stowing the anchor in the cavity.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE FIGURES

FIG. 2*a* is a side view of the rear portion of the AUV showing the elevator flight surface actuated downward so as to push the stern downward (arrow). FIG. 2*b* is a top view of the rear portion of the AUV where the rudder is actuated so as to push the stern to starboard (arrow), directing the vehicle to port, called 'left rudder.'

DETAILED DESCRIPTION

Figure 1:
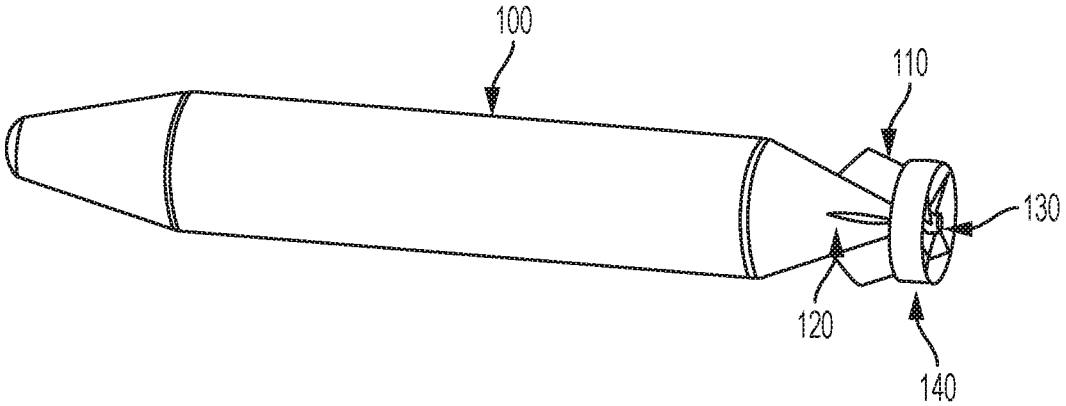
FIG. 1 PRIOR ART
FIG. 1 schematically illustrates a typical, conventional, torpedo-style AUV.

FIG. 1 schematically illustrates a typical, conventional torpedo-style AUV 100. They are generally cylindrical and tapered fore and aft, as shown, to reduce the vehicle's drag coefficient. They are propelled through the water generally by a single propeller 130 that is usually mounted near the stern of the vehicle. Control is provided by flight surfaces of rudders 110 and elevators 120, which are typically mounted near and just forward of the propeller 130. There may be other flight surfaces elsewhere on the vehicle and in principle there could be flight surfaces aft of the propeller 130. The propeller 130 may be located inside a protective ring 140 as illustrated. In some cases, flight surfaces may be absent and the main propeller or propulsion system is articulated (not shown) so as to direct thrust as needed for steering.

Figure 2:
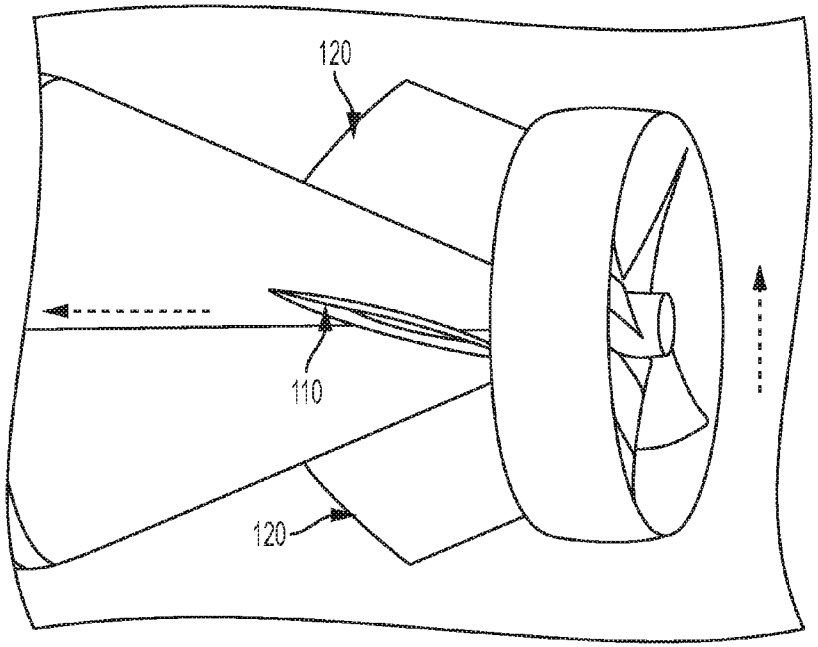
FIGS. 2*a* and 2*b* schematically illustrate the operation of the flight surfaces of a typical AUV as illustrated in FIG. 1.
Figure 2:
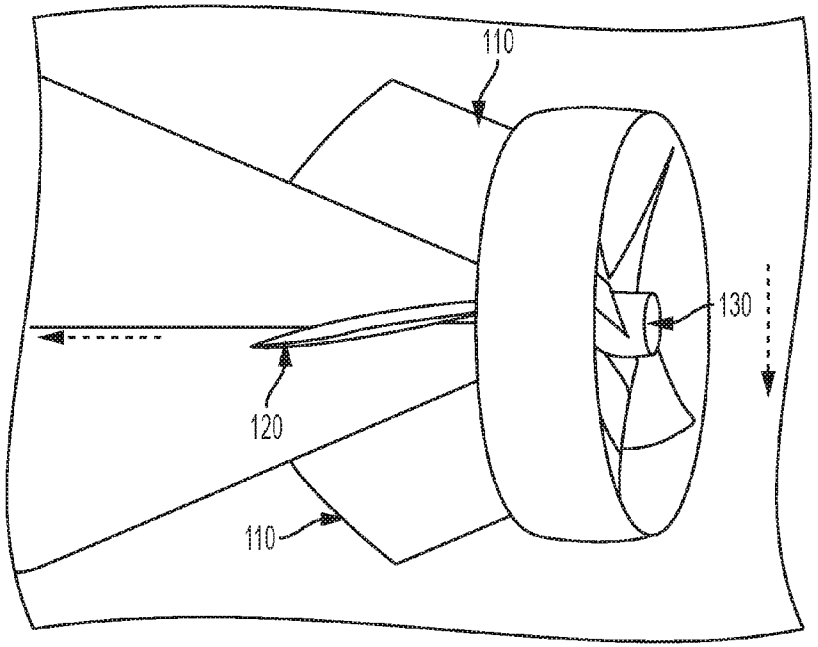
Figure 15:
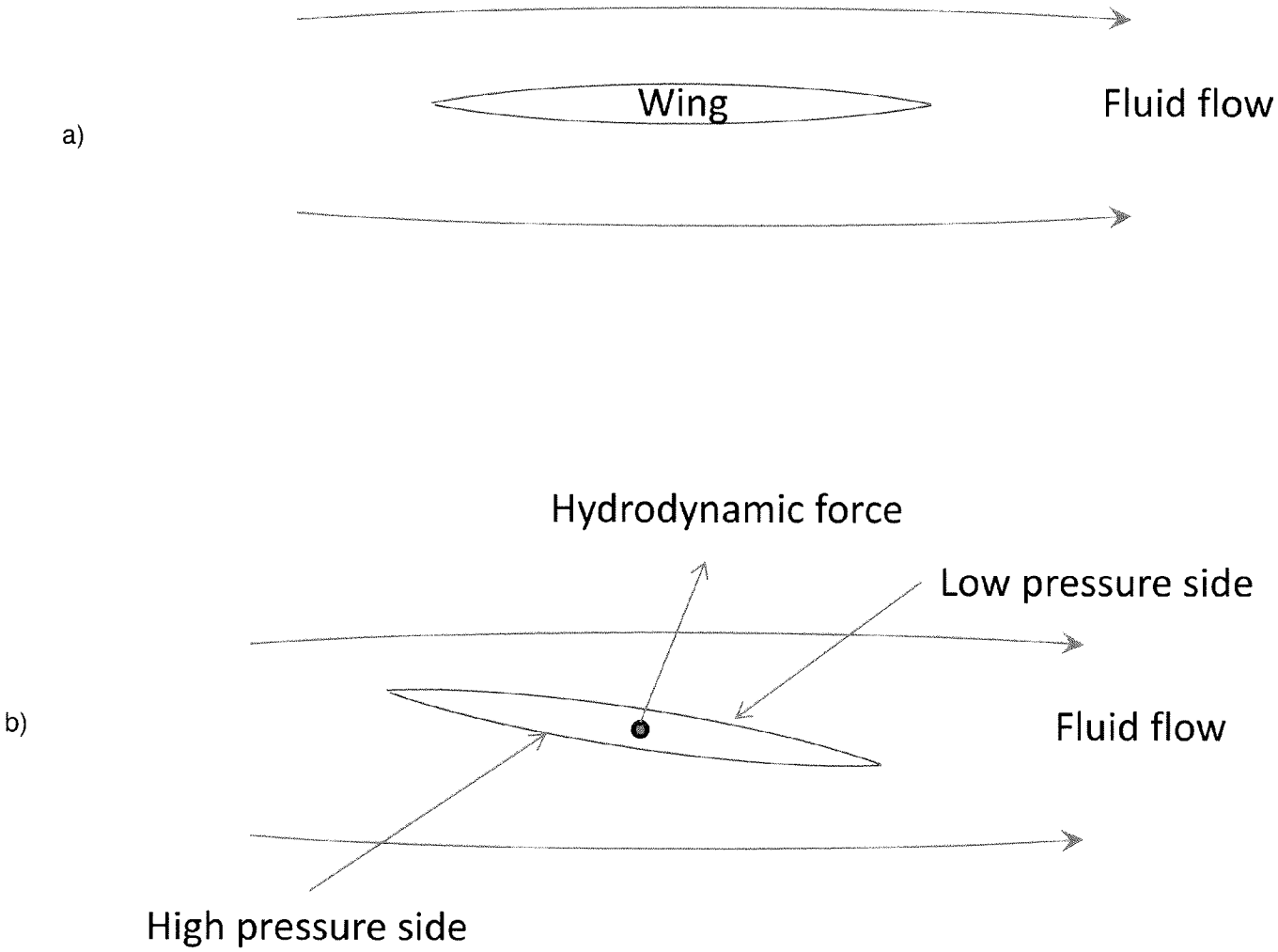
FIGS. 15(*a, b*) diagrammatically illustrate the hydrodynamic forces acting on a flight control surface of the AUV, according to an illustrative aspect of the invention.

FIGS. 2*a* and 2*b* schematically illustrate the operation of the flight surfaces of a typical AUV as illustrated in FIG. 1. FIG. 2*a* is a side view of the rear portion of the AUV showing the (port, left) elevator flight surface 120 actuated downward so as to push the stern downward (arrow). FIG. 2*b* is a top view of the rear portion of the AUV where the (top-side) rudder 110 is actuated so as to push the stern to starboard (arrow), directing the vehicle to port, known as 'left rudder.' These flight surfaces behave similarly to the smaller wings at the aft of an aircraft. While there can be and often are other flight surfaces forward on the vehicle, these are not required as they are on an aircraft because the entire AUV can be ballasted so as to be near neutrally buoyant in the water. The flight surfaces are effective at altering the path of the AUV by virtue of the hydrostatic forces developed as water passes over and around them during forward movement of the AUV (see FIG. 15). In normal AUV operations the motion is the uninterrupted forward motion of the vehicle. In accordance with the embodied invention, we wish to halt the AUV's motion and bring it to a controllable stop (hover mode). For the flight surfaces to be most effective while the vehicle is motionless, the flight surfaces are advantageously disposed in very close proximity forward or aft of the propeller 130 as illustrated in FIG. 2.

Figure 3:
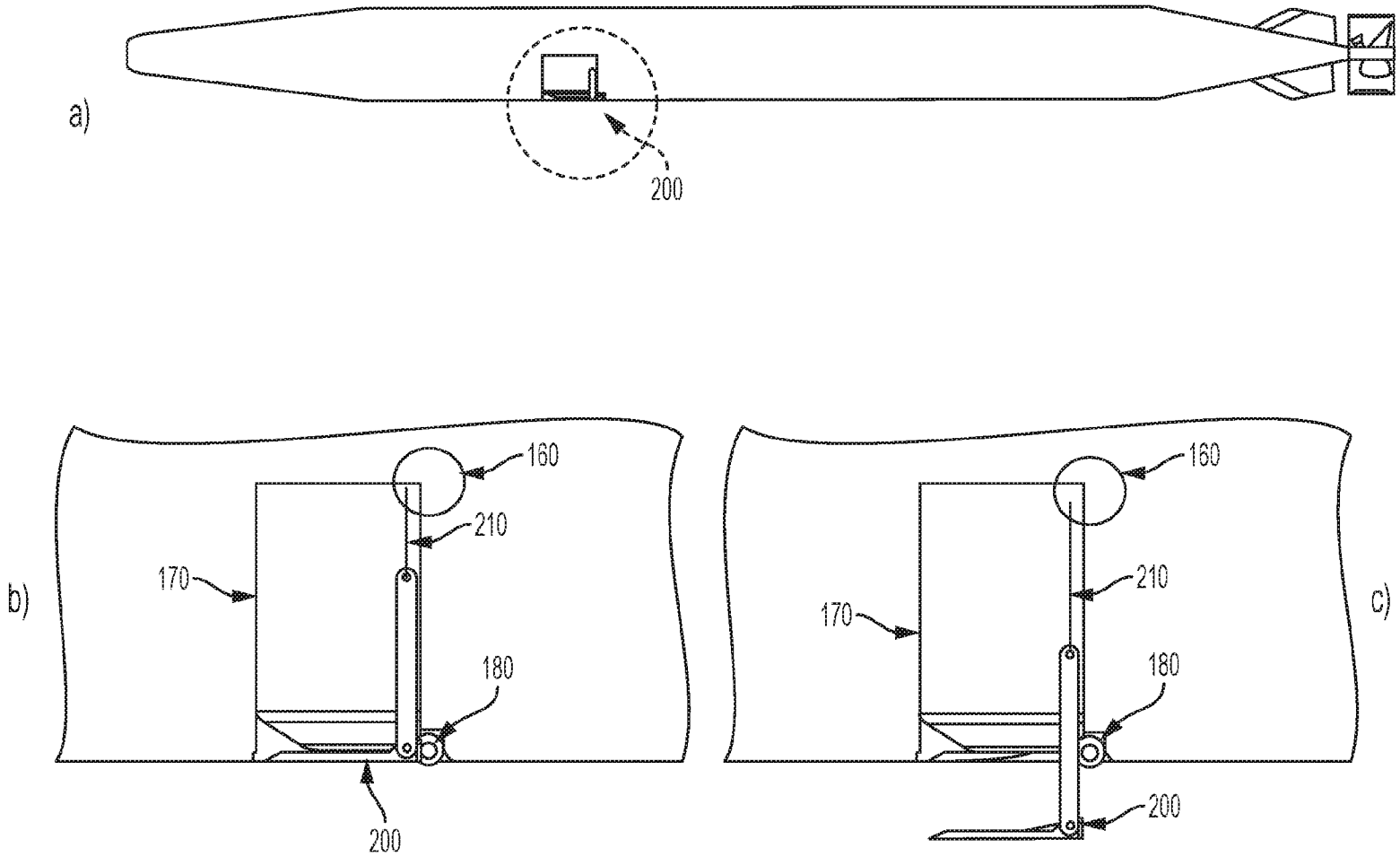
FIG. 3*a* is a schematic, side cross sectional view of an AUV, illustrating a compartment or cavity where an anchor can be stored and from where it can be deployed.
in FIG. 3*b*, the anchor is shown fully retracted into the cavity in the AUV body.
in FIG. 3*c*, the anchor is illustrated being deployed, according to illustrative aspects of the invention.

FIGS. 3(*a, b, c*) are views of an AUV and regions thereof, illustrating a compartment or cavity 170 in the body of the AUV where an anchor 200 can be stored and from where it can be deployed. In FIG. 3*b*, the anchor 200 is shown fully retracted into the cavity 170 in the AUV body by means of an anchor rode 210 attached to the anchor on one end and a winch 160 on the second end. In FIG. 3*c* the anchor 200 is illustrated being deployed by actuating the winch (or mechanism performing a similar function) 160 to pay out anchor rode 210 and anchor 200. Roller 180 prevents damage to the vehicle from the anchor and chafing on the anchor rode 210 as it is paid out and taken in.

Figure 4:
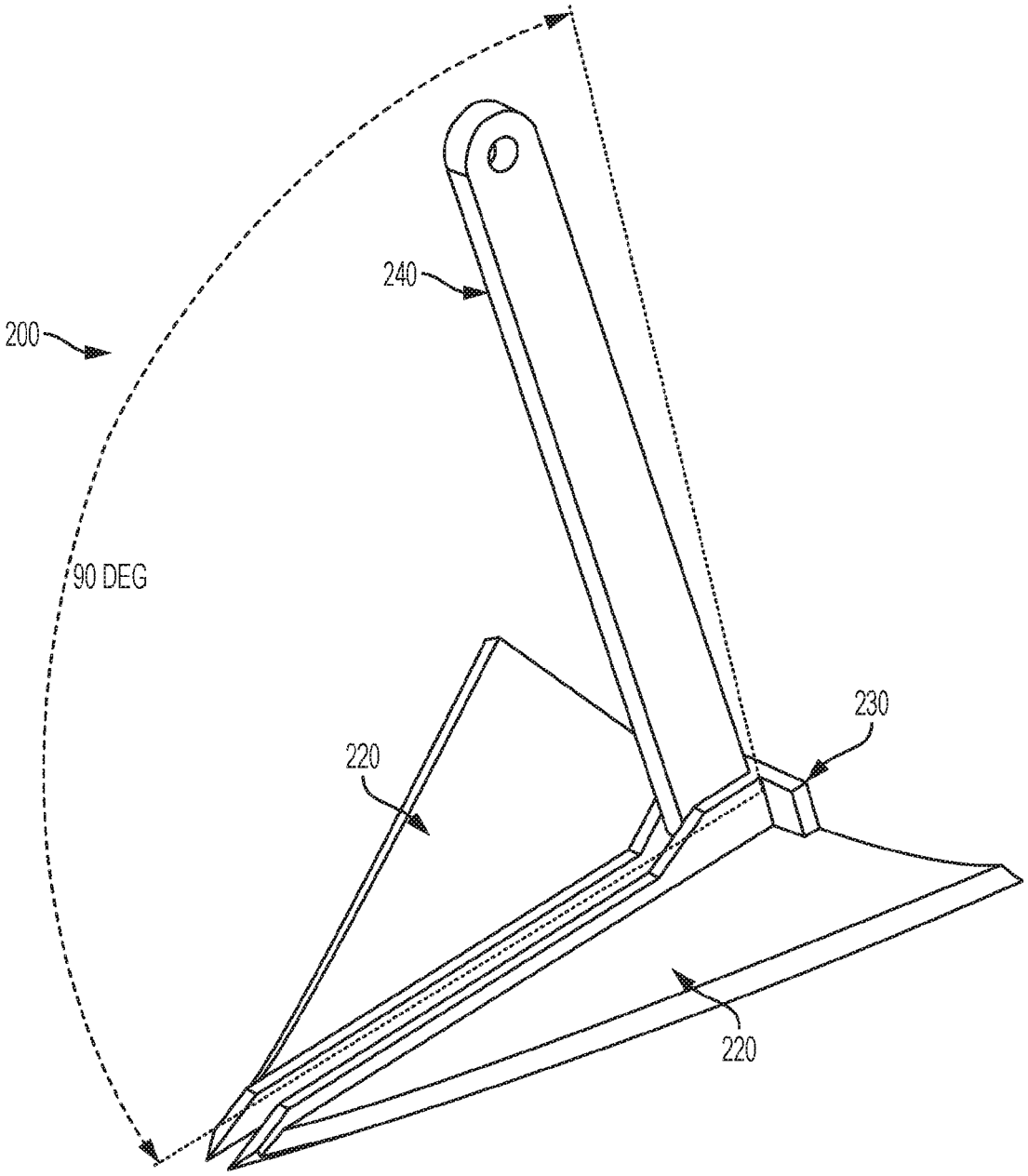
FIG. 4 shows an anchor according to an illustrative aspect of the invention.

FIG. 4 shows an anchor 200. In this non-limiting, illustrative aspect, a shank 240 can swing through 90 degrees as indicated, limited by the crown 230. Flukes 220 are fixed ridged relative to each other and shaped to conform to the outer skin of the AUV 100. It will be appreciated that the shape of the anchor, per se, can vary, but it is most advantageous if the anchor seats flush with the AUV body when stowed.

Figure 5:
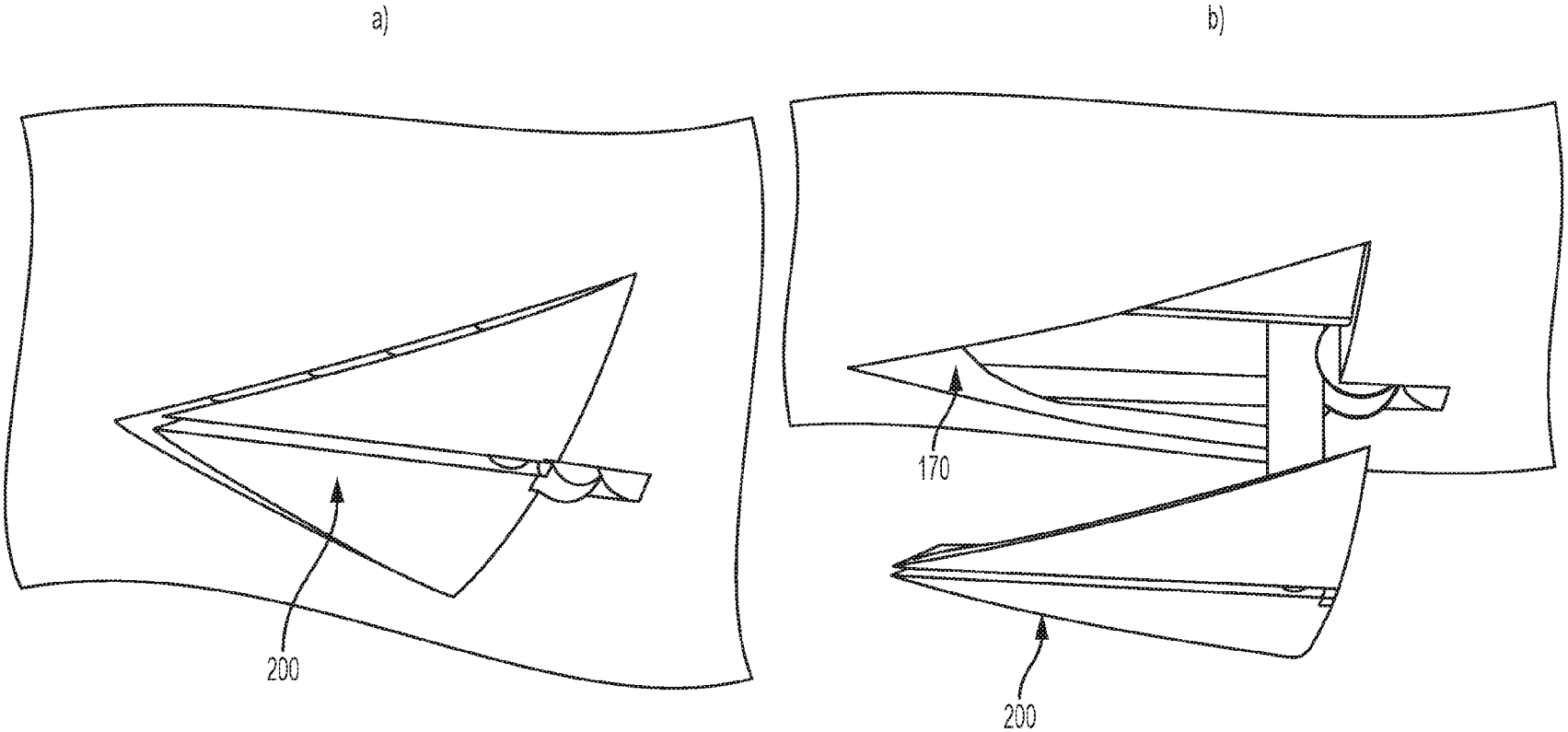
FIG. 5 schematically shows a bottom view of the AUV, a) with the anchor fully retracted and, b) as the anchor is being deployed, according to illustrative aspects of the invention.

FIG. 5*a* is a bottom view of the AUV with the anchor 200 fully retracted and stowed in the cavity 170. FIG. 5*b* illustrates the anchor beginning its deployment from the cavity.

Figure 6:
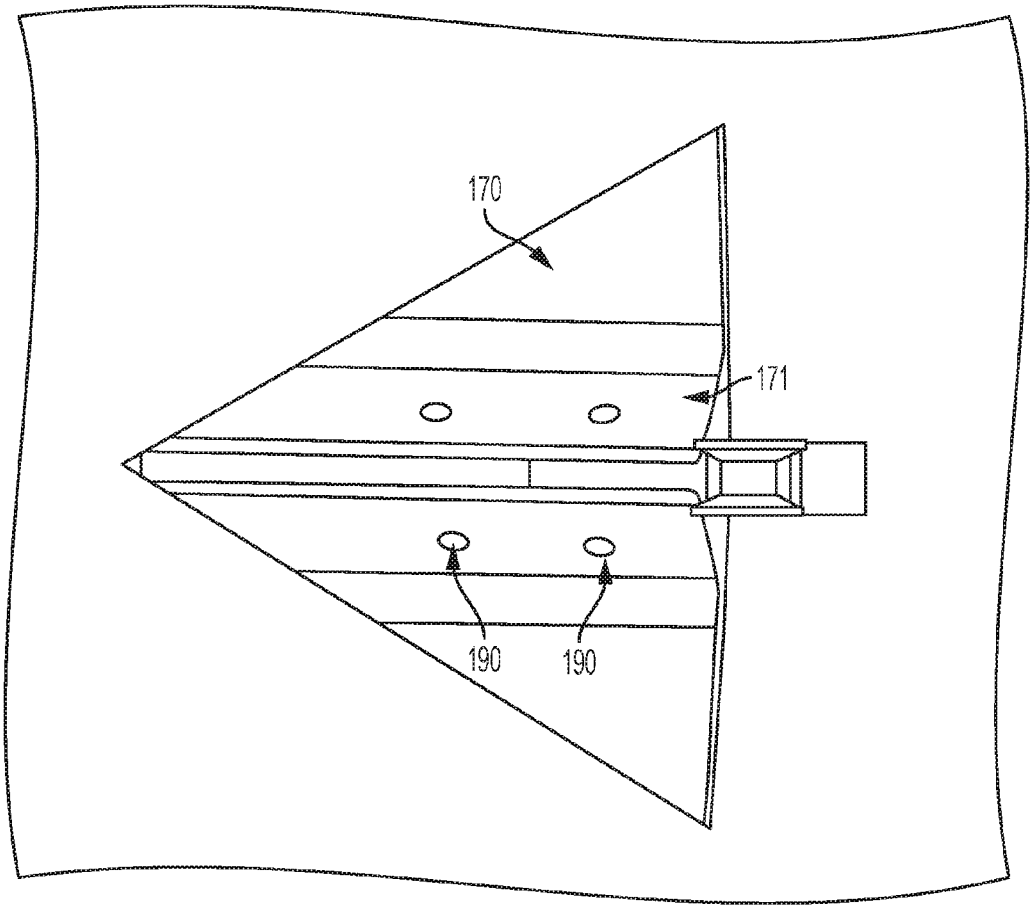
FIG. 6 further schematically illustrates the cavity into which the anchor can be recovered and stored, according to an illustrative aspect of the invention.
Figure 14:
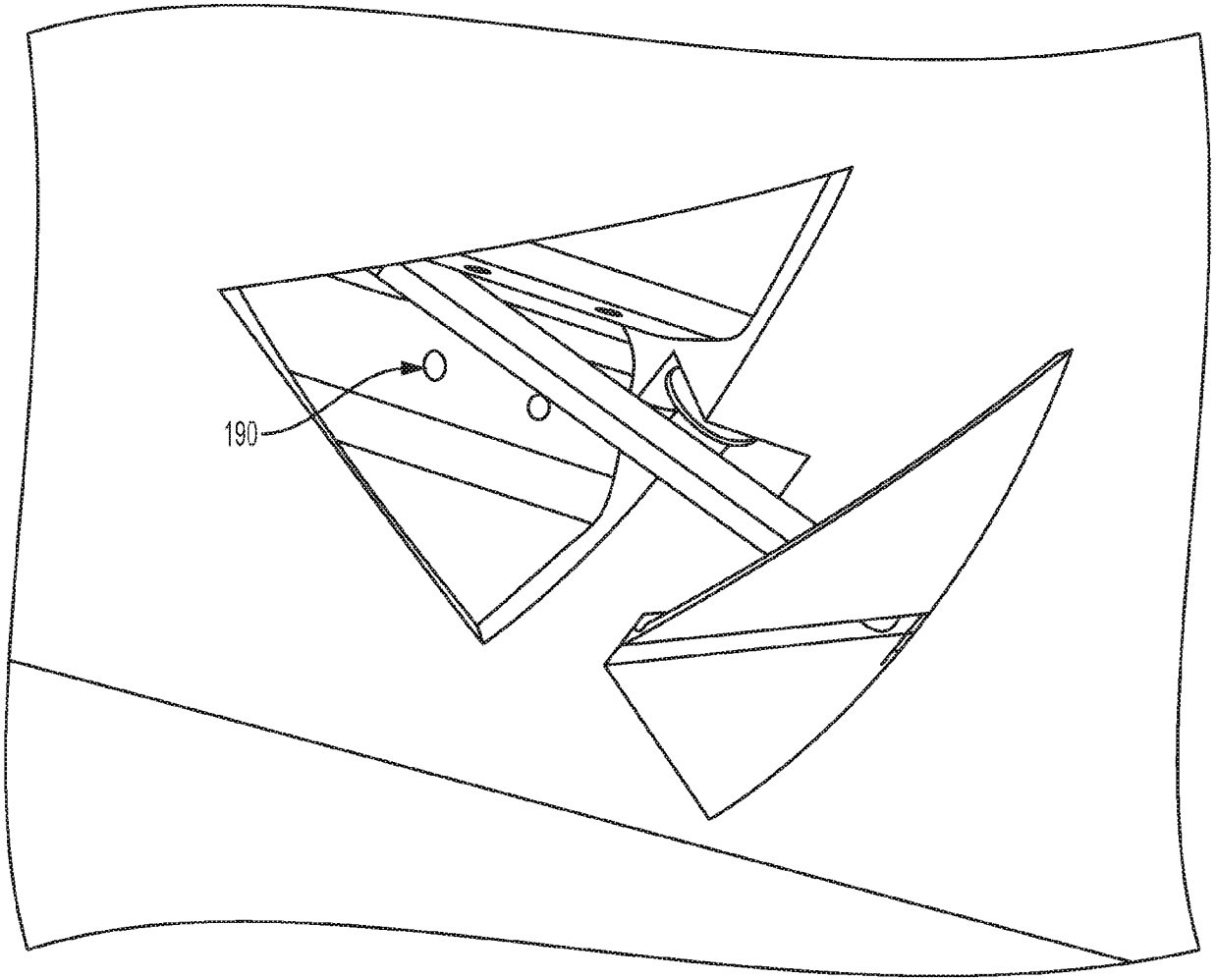
FIG. 14 schematically illustrates an anchor cavity as illustrated in FIG. 6, equipped with high pressure orifices, according to an illustrative aspect of the invention.

FIG. 6 further illustrates from a bottom plan view the cavity 170 into which the anchor 200 can be recovered and stored (see also FIG. 14). In an aspect, the cavity has contoured surfaces 171 designed so as to orient the anchor 200 correctly as the anchor shank 240 is pulled up into the cavity. Also illustrated are high-pressure water (or other fluid) jets 190 that are fitted into several surfaces and which can be actuated when the winch 160 has recovered the anchor, so as to clean away mud, sand or other bottom material which might be brought to the vehicle on the anchor 200 after engagement and disengagement with the marine bottom.

Figure 7:
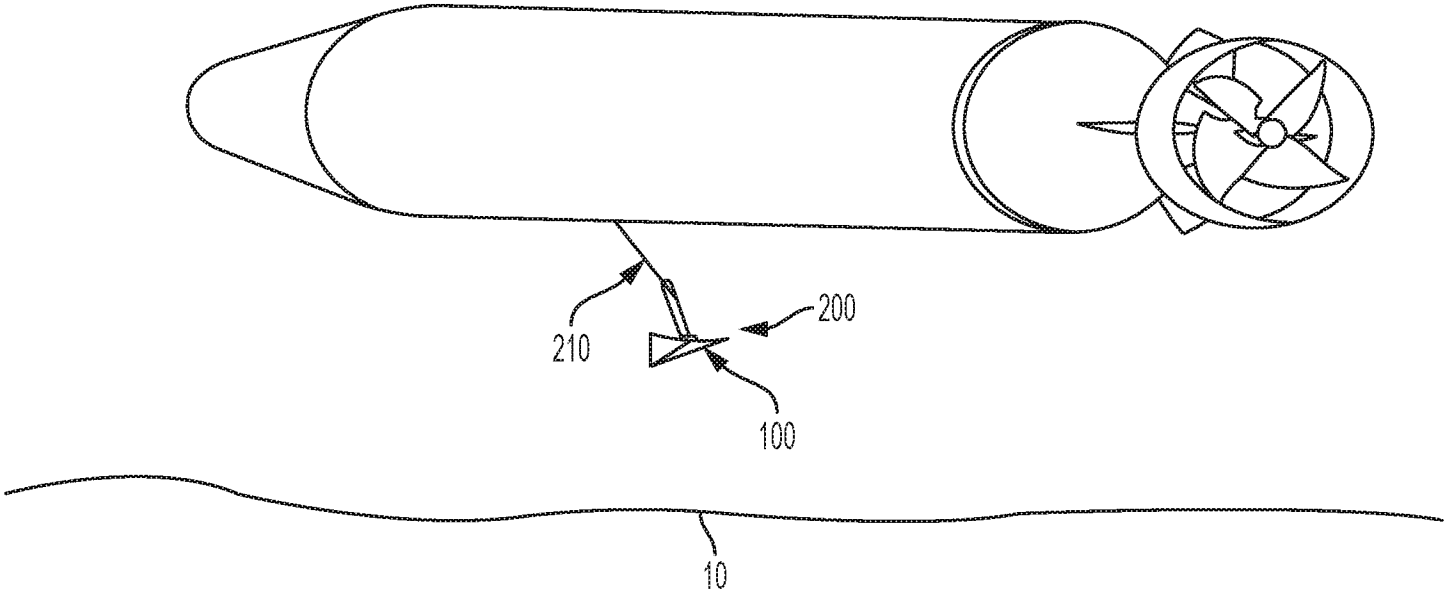
FIG. 7 is a schematic illustration of an AUV preparing to execute an operational hover mode, according to an illustrative aspect of the invention.

FIG. 7 is a schematic illustration of an AUV preparing to execute an operational hover mode. As the AUV nears a target (not shown), it slows and begins the anchor 200 deployment process. The winch 160 is actuated to pay out anchor rode 210, allowing anchor 200 to descend towards the marine bottom 10. The intent is to set the anchor 200 in the bottom, for e.g., 30 or more meters short of the target but within range permitted by the length of anchor rode 210.

Figure 8:
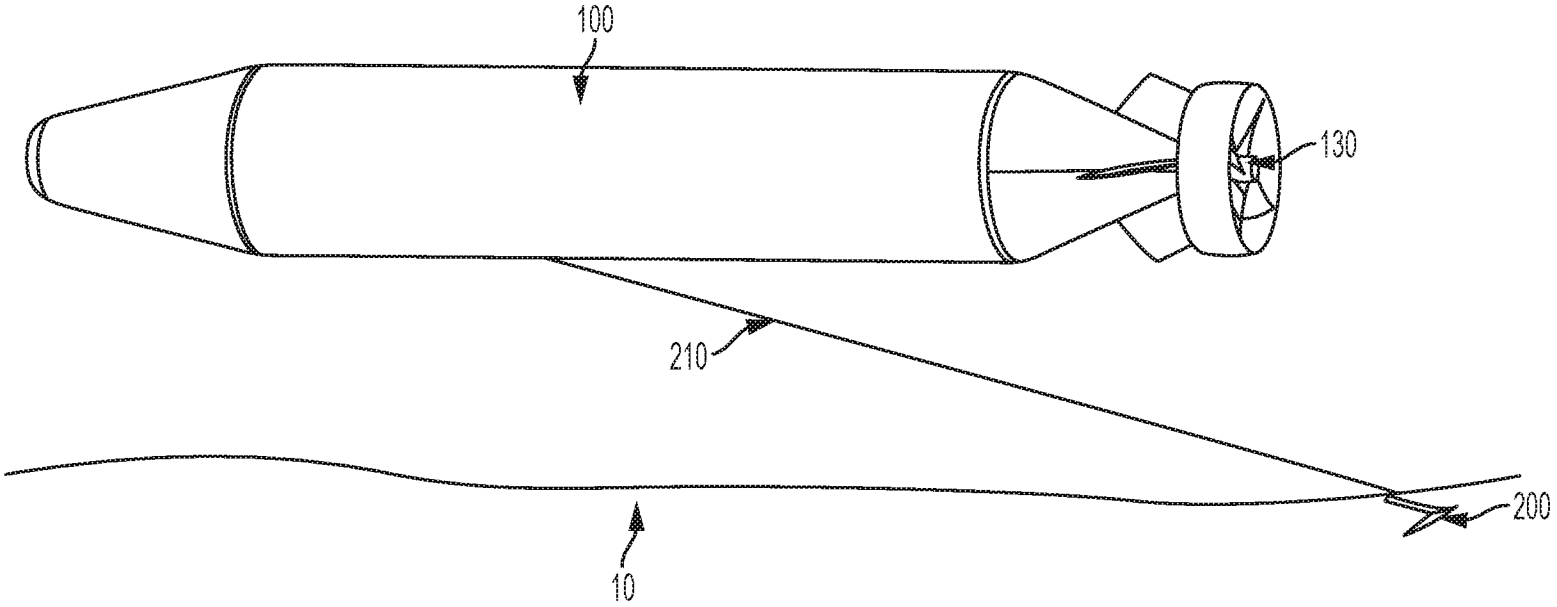
FIG. 8 schematically illustrates the AUV further preparing to execute an operational hover mode, according to an illustrative aspect of the invention.

As illustrated in FIG. 8, the anchor 200 is set in the marine bottom 10. The AUV 100 maintains slow activation of the propeller 130, permitting the elevators 120 and rudders 110 to maintain the attitude and heading of the AUV 100 while tension comes on the anchor rode 210. The AUV's forward motion is finally halted by the tension in anchor rode 210 except for that permitted by continued pay-out of anchor rode 210. It should be noted that after anchor 210 is set on the marine bottom, the AUV 100 is made more buoyant by the absence of the weight of the anchor 210 no longer aboard. The AUV 100, which was close to neutrally buoyant before the anchor 210 deployment, now is positively buoyant after deployment and will tend to rise in the water column, limited by the anchored line.

Figure 9:
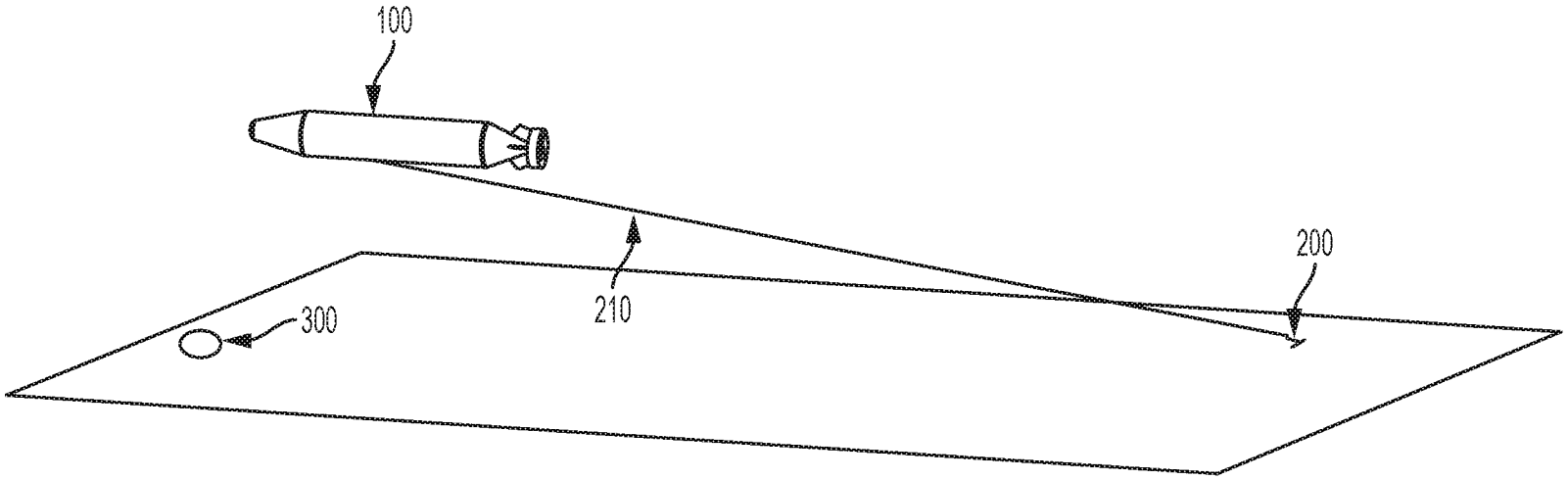
FIG. 9 schematically illustrates the AUV in a controllable, operational hover mode, according to an illustrative aspect of the invention.

As illustrated in FIG. 9, anchor rode 210 is further payed out to allow the AUV 100 to slowly approach the target 300. The AUV 100 continues slow activation of its propeller 130, thus maintaining the effectiveness of its rudders 120 and elevators 110 and tension in the anchor rode 210; i.e., the propeller speed is slowed sufficiently, as one skilled in the art would understand, so as not to create so much force that would pull the anchor out or through the mud, but just fast enough to keep water moving over the rudder and elevator. In this way, the propeller acts like a fan maintaining flowing fluid over the flight surfaces so that they remain operatively effective (see FIG. 15). Under these conditions, the AUV 100 is much like a bob on a pendulum. At this point, the AUV is in a stationary hover mode and, as such, may more effectively transmit data between the target (e.g., seismic node) and the AUV or carry out other operations.

Figure 10:
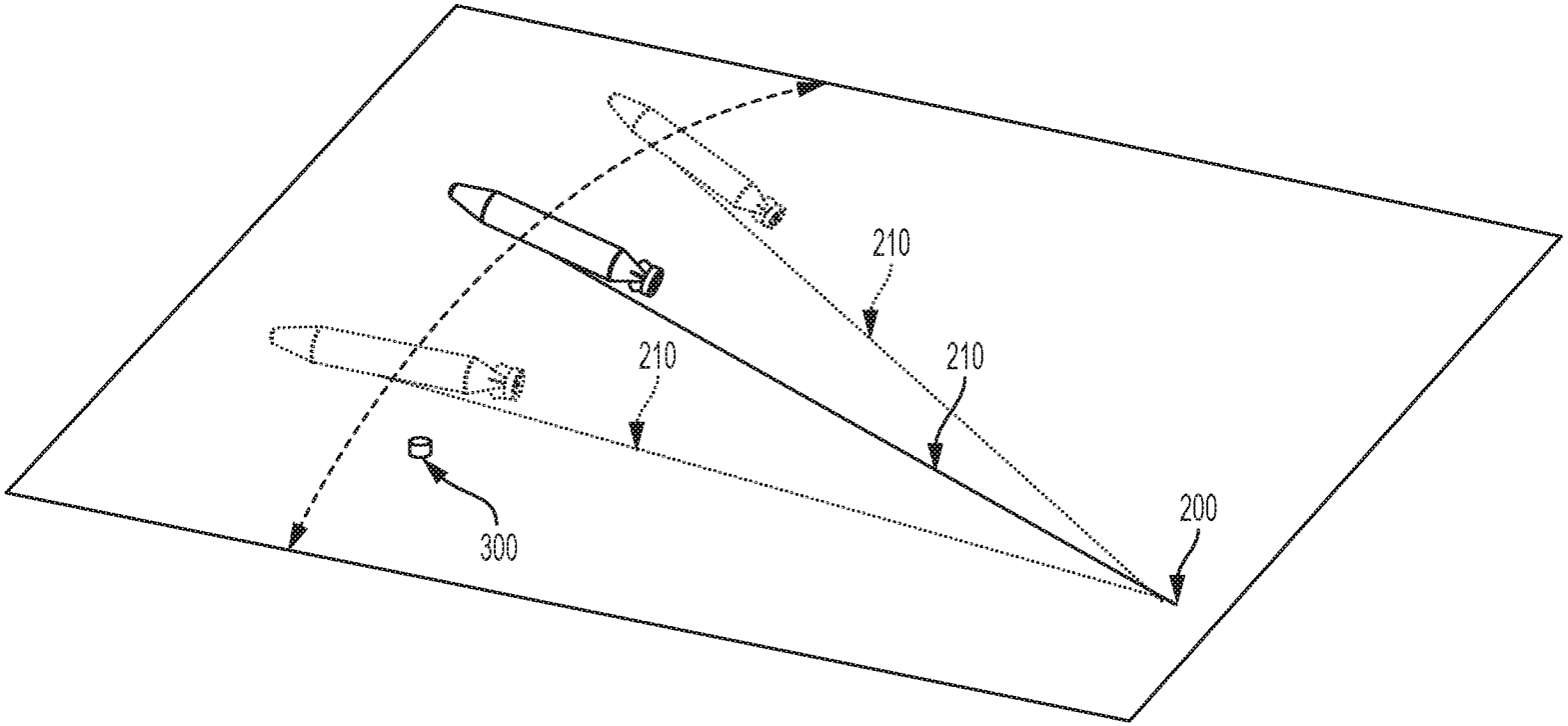
FIG. 10 is a perspective view of the AUV shown in FIG. 9 being controlled to hover substantially in a horizontal plane, according to an illustrative aspect of the invention.

FIG. 10 illustrates the AUV in another aspect of an operational hover mode in which the operation of its rudders 120 effects movement of the non-forward (+x direction) moving AUV in an arc from side to side. This movement may be used to further refine the position of the AUV with respect to target 300 or may allow positioning of the AUV in operational contact with one or more other targets (not shown).

Figure 11:
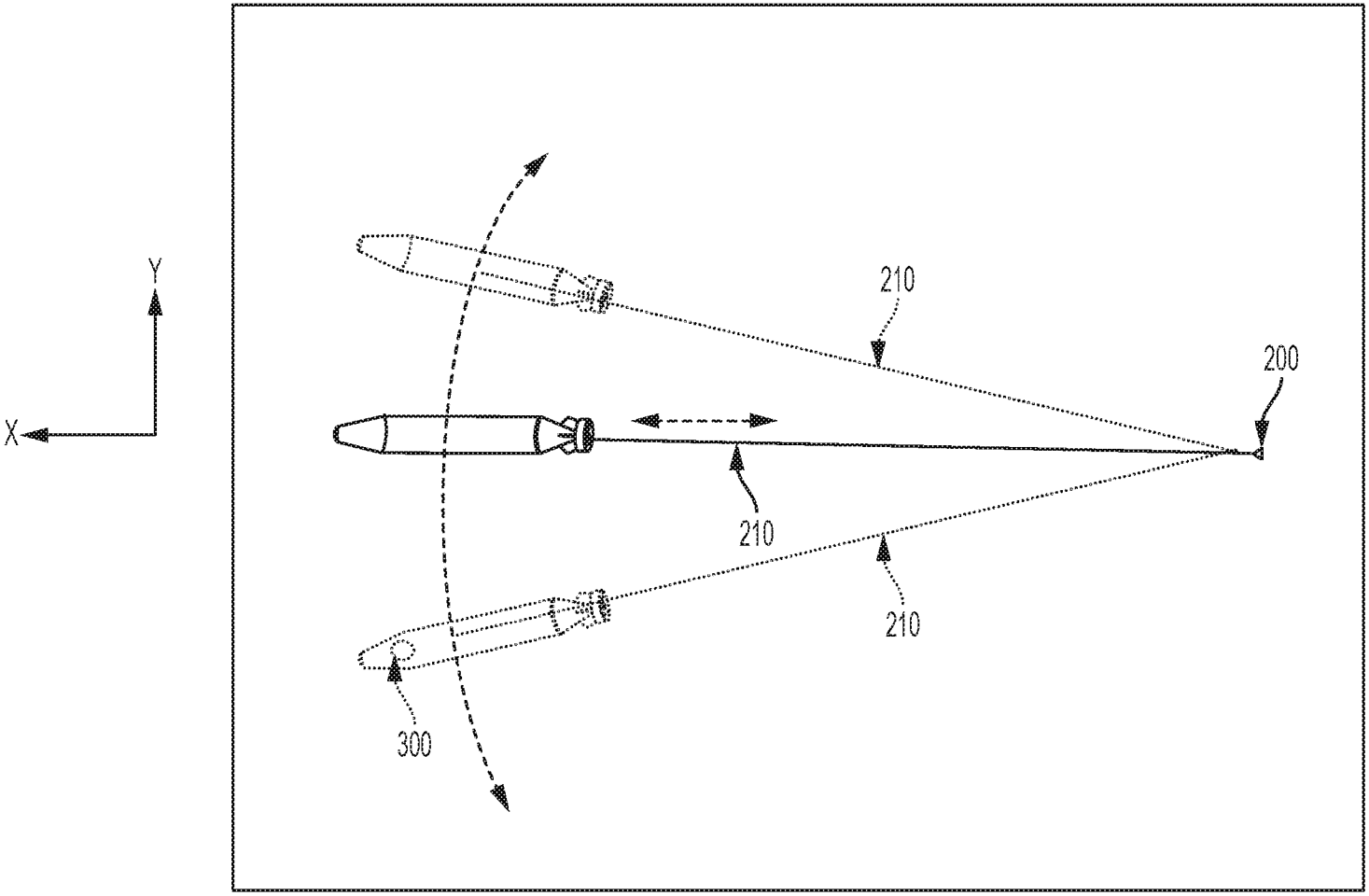
FIG. 11 is a plan view of the perspective view shown in FIG. 10, according to an illustrative aspect of the invention.

FIG. 11 is a plan view of the perspective view shown in FIG. 10. The AUV's x-position (range) is adjusted by paying out or taking up anchor rode 210. The vehicle's polar, y-position is adjusted by activation of its rudders 120. Together these mechanisms permit a sensor (not shown) on or in the AUV to be positioned directly above or beside a target as required to accomplish touchless data transfer.

Figure 12:
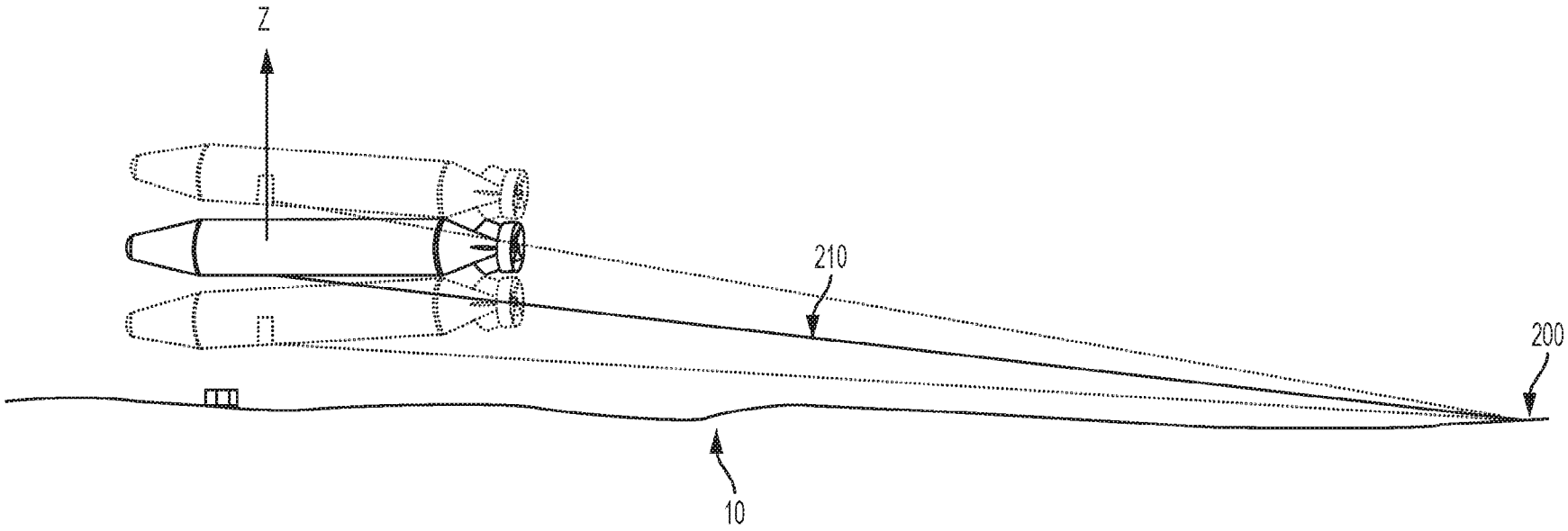
FIG. 12 schematically illustrates the AUV shown in FIG. 9 being controlled to hover substantially in a vertical plane, according to an illustrative aspect of the invention.

FIG. 12 illustrates the AUV in another aspect of an operational hover mode in which operation of the AUV's elevators 110 effect the attitude (vertical or z-direction in the water column) of the AUV, therein altering its elevation in relation to a target on the marine bottom.

Figure 13:
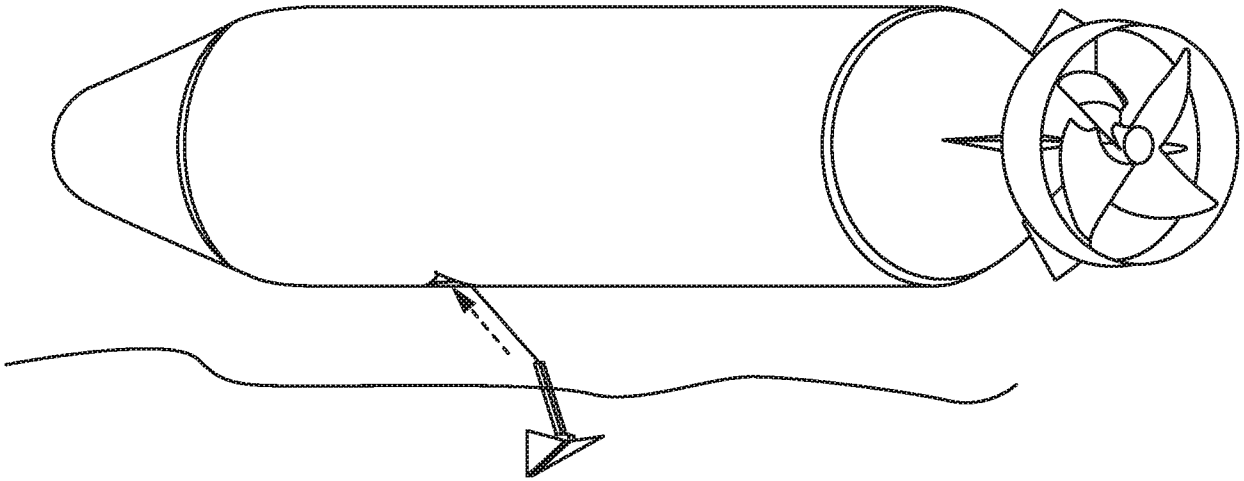
FIG. 13 is similar to FIG. 7, only showing retraction of the anchor after completion of hover mode operation, according to an illustrative aspect of the invention.

With reference to FIG. 13, when the data collection or other mission attended by the hovering AUV is complete, the anchor rode 210 is winched in by winch 160, pulling the AUV backwards (−x direction) towards the anchor's 200 set point (see FIGS. 7, 8) and well clear of the target 300.

There is a risk that the anchor 200 may break free as its shank 240 is righted or that the AUV 100 may be pulled to the bottom 10 while the anchor 200 is taken aboard the AUV during retraction. To help alleviate these or other potential problems and their consequences, high pressure water (or other fluid) jets 190 are installed in the cavity 170 that houses the anchor 200, as shown in FIGS. 6 and 14. A useful pressure value will be easily determined by a person skilled in the art. The high-pressure jets can be activated as the anchor 200 nears the cavity to clear the anchor 200 of bottom mud, sand or debris. This will of course stir up the mud or sand but well away from the target 300 and after the mission is completed at this target.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

I claim:

1. An underwater vehicle, comprising:

an elongate body including a bow region and a stern region, wherein the body includes a cavity disposed between the bow region and the stern region;

an anchor rode extender/retractor mechanism disposed within or on the body;

an anchor rode coupled at one region thereof to the anchor rode extender/retractor mechanism;

an anchor coupled to another region of the anchor rode and adapted to be disposed in the cavity in a retracted mode; and a propulsion/stabilization component, further comprising an orifice disposed in the c wherein the orifice provides a conduit for a high-pressure fluid exit from the cavity, wherein the underwater vehicle is an autonomous underwater vehicle (AUV).

2. The AUV of claim 1, wherein the anchor further includes a shank portion connected at a free end thereof to the another region of the anchor rode.

3. The AUV of claim 2, wherein the shank portion is freely, pivotally connected to the anchor and moveable through a range of about zero degrees to about 90 degrees.

4. The AUV of claim 1, wherein the propulsion/stabilization component includes a propeller mechanism disposed at or near the stern region and a controllable flight surface on the body.

5. The AUV of claim 1, wherein the controllable flight surface comprises a pair of elevators and rudders disposed aft of the propeller or substantially forwardly immediately adjacent of the propeller.

6. The AUV of claim 1, wherein the propulsion/stabilization component includes an articulated propeller mechanism.

7. The AUV of claim 1, wherein the cavity is configured with respect to the anchor such that an exterior surface of the anchor is substantially flush with the body when the anchor is fully disposed in the cavity.

8. A method for controlling a submersed autonomous underwater vehicle (AUV), comprising:

providing an AUV having a deployable anchor on an anchor rode in a cavity of the AUV, and at least one of a) a combined propulsion/stabilization component and b) a propulsion component and a controllable flight surface, traveling at a given speed in a substantially horizontal, X-direction, in a marine environment;

reducing the speed of the AUV while maintaining a minimal thrust sufficient for effective operation of the flight surface;

deploying the AUV anchor from the cavity so that it engages the bottom of the marine environment a predetermined distance short of a known target position on the bottom of the marine environment;

paying out or taking up a length of the anchor rode so as to adjust a position of the AUV in the X-direction in relation to the known target position; and further reducing the speed of the AUV in the X-direction to zero while maintaining a thrust sufficient for effective operation of the flight surface, whereby the AUV is in a hover mode proximate the target position.

9. The method of claim 8, further comprising activating the at least one of the combined propulsion/stabilization component and the controllable flight surface so as to adjust a polar (radial), Y-position of the hovering AUV in relation to the target position.

10. The method of claim 9, wherein the flight surface is a rudder.

11. The method of claim 9, wherein the combined propulsion/stabilization component includes an articulated thrust mechanism.

12. The method of claim 8, further comprising activating the at least one of the combined propulsion/stabilization component and the controllable flight surface so as to adjust a vertical (elevation), Z-position of the hovering AUV in relation to the target position.

13. The method of claim 12, wherein the flight surface is an elevator.

14. The method of claim 12, wherein the combined propulsion/stabilization component includes an articulated thrust mechanism.

15. The method of claim 8, further comprising exiting the hover mode by reeling-in the anchor rode, wherein the AUV is pulled backwards away from the target position and towards the anchor that is engaged with the bottom of the marine environment.

16. The method of claim 15, further comprising jetting a fluid at a determined high pressure from an orifice in the cavity when the anchor is in close proximity to the cavity and stowing the anchor in the cavity.

* * * * *